US009772157B2

(12) United States Patent
Yoakam

(10) Patent No.: US 9,772,157 B2
(45) Date of Patent: Sep. 26, 2017

(54) PROJECTILE LAUNCHING DEVICE

(71) Applicant: John Arthur Yoakam, North Ridgeville, OH (US)

(72) Inventor: John Arthur Yoakam, North Ridgeville, OH (US)

( * ) Notice: Subject to any disclaimer, the term of this patent is extended or adjusted under 35 U.S.C. 154(b) by 806 days.

(21) Appl. No.: 13/747,544

(22) Filed: Jan. 23, 2013

(65) Prior Publication Data

US 2015/0241158 A1 Aug. 27, 2015

(51) Int. Cl.
*F41A 21/30* (2006.01)
*F41A 21/28* (2006.01)

(52) U.S. Cl.
CPC ..... *F41A 21/30* (2013.01); *F41A 21/28* (2013.01)

(58) Field of Classification Search
CPC ..... F41A 21/30; F41A 21/28; F41A 13/00; F41A 13/10; F41A 5/26; F41A 3/06; F41A 21/00; F41A 21/325; F41A 21/34; F41A 21/32; F41A 21/02; F41A 21/24; F41A 21/44; F41A 21/36; F41B 11/62; F41B 11/00; F41B 11/723; Y10T 29/49398; F42B 6/00; F42B 14/064
USPC ..... 89/14.4, 8
See application file for complete search history.

(56) References Cited

U.S. PATENT DOCUMENTS 951,770 A * 3/1910 Miller ..... F01N 1/06 181/253
955,694 A * 4/1910 Riggs ..... F41A 21/30 181/223
1,000,702 A * 8/1911 Thurler ..... F41A 21/30 181/223
1,143,814 A * 6/1915 De Vries ..... F41A 21/30 181/223
1,290,596 A * 1/1919 Lewis ..... F41A 1/04 89/14.4
1,341,363 A * 5/1920 Fiala ..... F41A 21/30 181/223

(Continued)

OTHER PUBLICATIONS

R. Paakkonen; "Environmental noise reduction means of weapons"; Finnish Institute of Occupational Health, Jun. 29, 2008, 4 pages.

*Primary Examiner* — Michelle R Clement
*Assistant Examiner* — Bridget Cochran
(74) *Attorney, Agent, or Firm* — Renner, Otto, Boisselle & Sklar, LLP

(57) ABSTRACT

A projectile launching device includes a primary tube having a primary passage for launching a projectile. In some embodiments, the projectile launching device further includes a secondary tube disposed about the primary tube and defining a secondary passage, and a flow apparatus in fluid communication with the secondary passage configured to move gas through the secondary passage. An opening is at the end of the secondary tube and is configured to allow gas to laminarly exit the secondary passage. In other embodiments, the projectile launching device further includes a flow apparatus in fluid communication with the primary passage configured to draw gas from the primary passage to provide at least a partial vacuum in the primary passage. The projectile launching device may provide increased range, accuracy, and velocity of the projectile, in addition to providing a reduced sound signature of the projectile launching device.

17 Claims, 6 Drawing Sheets

(56) References Cited

U.S. PATENT DOCUMENTS 1,356,858 A * 10/1920 Fitzpatrick ..... F41B 11/00 114/238
1,838,645 A * 12/1931 Voigt ..... F01N 3/04 110/119
2,126,792 A * 8/1938 MacGregor ..... F41A 13/12 89/14.1
2,337,840 A * 12/1943 Hubert Scott-Paine ..... F41A 13/12 89/14.1
2,397,556 A * 4/1946 Magill ..... F01N 1/08 181/239
2,449,571 A * 9/1948 Walker ..... F41A 21/30 181/223
2,754,607 A * 7/1956 Wily ..... F41C 3/04 42/55
2,960,977 A * 11/1960 Moorhead, Jr. ..... F41B 11/00 124/32
3,132,562 A * 5/1964 Frevel ..... F41F 3/04 124/56
3,340,769 A * 9/1967 Waser ..... F41A 21/28 42/76.01
3,357,306 A * 12/1967 Boyd ..... F41A 1/02 73/12.11
3,399,597 A * 9/1968 Perrine ..... F41A 21/30 181/223
3,418,878 A * 12/1968 Stricklin ..... F41A 1/02 42/76.01
3,459,101 A * 8/1969 Scanlon, Jr. ..... F41A 1/00 89/1.1
3,786,895 A * 1/1974 Perrine ..... F01N 1/003 181/223
3,880,044 A * 4/1975 Korr ..... F41A 1/02 42/105
4,159,588 A * 7/1979 Pfeiffer ..... F41A 23/18 211/64
4,222,456 A * 9/1980 Kasper ..... F01N 1/06 181/238
4,501,189 A * 2/1985 Brandl ..... F41A 21/30 181/223
4,590,842 A * 5/1986 Goldstein ..... F41B 6/00 376/102
4,685,534 A * 8/1987 Burstein ..... F01N 1/00 181/223
4,938,112 A * 7/1990 Hertzberg ..... F41A 1/02 60/768
5,033,356 A * 7/1991 Richardson ..... F41A 21/30 181/223
5,097,743 A * 3/1992 Hertzberg ..... F41A 1/02 60/767
5,123,329 A * 6/1992 Irwin ..... F41A 5/16 89/14.3
5,136,923 A * 8/1992 Walsh, Jr. ..... F41A 21/30 89/14.2
5,233,903 A * 8/1993 Saphier ..... F41A 1/02 89/7
5,355,765 A * 10/1994 Rogers ..... F41A 13/12 89/14.4
5,381,722 A * 1/1995 Begneu ..... F41A 1/04 89/7
5,398,589 A * 3/1995 Kazyaka ..... F41A 21/30 181/223
5,631,436 A * 5/1997 Brown ..... F41A 1/04 89/7
5,653,216 A * 8/1997 Johnson ..... A63H 27/005 124/69
5,798,473 A 8/1998 Roblyer et al.
6,192,612 B1 * 2/2001 Maier ..... F41A 1/04 42/54
6,575,266 B1 * 6/2003 Gehse ..... F41A 21/36 181/223
6,622,647 B2 9/2003 DePoy
6,848,538 B2 * 2/2005 Shafer ..... F41B 11/00 181/223
6,851,348 B1 * 2/2005 Ang ..... F41A 13/04 89/1.2
6,904,901 B2 * 6/2005 Mitchell ..... F41B 11/641 124/65
7,159,692 B1 * 1/2007 Frederiksen ..... F01N 1/08 181/227
7,207,258 B1 * 4/2007 Scanlon ..... F41A 21/30 181/223
7,337,774 B2 * 3/2008 Webb ..... F41B 11/62 124/60
7,594,465 B2 9/2009 Borgwarth et al.
7,644,804 B2 * 1/2010 Harman ..... F01N 1/12 137/810
7,775,148 B1 * 8/2010 McDermott ..... F41A 1/02 124/60
7,882,829 B2 * 2/2011 Witzigreuter ..... F41B 11/723 124/65
8,037,877 B2 * 10/2011 Liao ..... F41A 9/55 124/1
8,056,462 B1 * 11/2011 Lacy ..... F41B 11/62 124/73
8,079,356 B2 * 12/2011 Reible ..... F41B 11/52 124/77
8,096,073 B2 * 1/2012 Vielbig ..... F41A 21/28 42/1.01
8,397,862 B2 * 3/2013 Shand ..... F41A 21/30 181/223
8,453,789 B1 * 6/2013 Honigmann ..... F41A 21/30 181/223
8,516,941 B1 * 8/2013 Oliver ..... F41A 21/30 181/223
8,567,556 B2 * 10/2013 Dueck ..... F41A 21/30 181/223
8,671,928 B2 * 3/2014 Hague ..... F41B 11/721 124/73
8,967,325 B1 * 3/2015 Cronhelm ..... F41A 13/00 181/223
9,033,306 B2 * 5/2015 Kunau ..... B60C 25/145 141/38
9,080,832 B2 * 7/2015 Brahler, II ..... F41B 11/723
2004/0094025 A1 * 5/2004 Meissner ..... F41A 13/10 89/14.1
2004/0129131 A1 * 7/2004 Kazyaka ..... F41A 21/28 89/14.4
2005/0034346 A1 2/2005 Smith
2005/0108917 A1 * 5/2005 Kunstmann ..... F41F 3/073 42/135
2005/0252500 A1 * 11/2005 Morikawa ..... F41B 11/89 124/71
2012/0080261 A1 * 4/2012 Shand ..... F41A 21/30 181/223
2012/0180772 A1 * 7/2012 St. Phillips ..... F41B 11/723 124/73
2012/0273297 A1 * 11/2012 Schlosser ..... F01N 1/026 181/213
2013/0104868 A1 * 5/2013 Sikes ..... F41B 11/724 124/77
2014/0216237 A1 * 8/2014 Butler ..... F41A 21/30 89/14.4
2014/0360807 A1 * 12/2014 McKenzie ..... F41A 21/30 181/223
2015/0337878 A1 * 11/2015 Schlosser ..... F42B 10/42 181/213

* cited by examiner

PROJECTILE LAUNCHING DEVICE

TECHNICAL FIELD

The present disclosure relates to projectile launching, and particularly to a projectile launching device.

BACKGROUND

Devices for launching projectiles such as guns and rifles are typically used for launching projectiles such as bullets. Improving the range and accuracy of the projectile has become an area of interest, but due to the design of conventional projectile launching devices, the range and accuracy of the projectile is an issue.

SUMMARY

The present disclosure provides a projectile launching device. The projectile launching device includes a primary tube having a primary passage for launching a projectile. In some embodiments, the projectile launching device further includes a secondary tube disposed about the primary tube and defining a secondary passage, and a flow apparatus in fluid communication with the secondary passage configured to move gas therethrough. An opening is at the end of the secondary tube and is configured to allow gas to laminarly exit the secondary passage. In other embodiments, the projectile launching device further includes a flow apparatus in fluid communication with the primary passage configured to draw gas from the primary passage to provide at least a partial vacuum in the primary passage. The projectile launching device may provide increased range, accuracy, and velocity of the projectile, in addition to providing a reduced sound signature of the projectile launching device.

According to one aspect of the present disclosure, a projectile launching device includes a primary tube extending along a length disposed between a first end and a second end and defining a primary passage extending along a length thereof, the primary tube having an opening at the second end of the primary tube configured to allow a projectile to exit the primary passage; a secondary tube extending along a length between a first end and a second end and defining a secondary passage extending along a length thereof, the secondary tube disposed about the primary tube and having an opening at the second end of the secondary tube proximate the second end of the primary tube; and a flow apparatus in fluid communication with the secondary passage and configured to move gas through the secondary passage; wherein the opening at the second end of the secondary tube is configured to allow a gas to laminarly exit the secondary passage.

At least one of the primary tube and the secondary tube may be substantially cylindrical.

The secondary passage may be substantially annular in shape.

The secondary passage may be at least partially defined by at least a portion of an outer surface of the primary tube.

The secondary passage may include one or more fixed or moving vanes, blades, or fins configured to impart a rotational component to gas passing through the secondary passage.

The secondary passage may have an intermediary section extending between the first end and the second end of the secondary tube, wherein the cross-sectional area of the intermediary section is greater than a cross-sectional area of the opening of the secondary tube.

The opening of the primary tube may define a primary end face and the opening of the secondary tube may define a secondary end face disposed substantially parallel to the primary end face.

The gas may include at least one of air or a compressed gas.

The projectile launching device may further include a connecting passage, the connecting passage providing fluid communication between the primary passage and an intake of the flow apparatus.

The flow apparatus may be configured to draw gas from the primary passage thereby providing at least a partial vacuum in the primary passage.

The projectile launching device may include an exhaust diversion passage, the exhaust diversion passage providing fluid communication between the primary passage and the secondary passage.

The secondary passage may be configured to draw air out of the opening of the primary passage via inducement or entrainment.

An intake of the flow apparatus may be open to the atmosphere and the flow apparatus is configured to move gas through the secondary passage via inducement of surrounding air into the secondary passage.

The flow apparatus may include at least one of a blower, a pump, a roughing pump, a turbo molecular pump, or a chamber of compressed gas.

According to another aspect of the present disclosure, a projectile launching device includes a primary tube defining a primary passage extending along a length disposed between a first end and a second end, the primary tube having an opening at the second end configured to allow a projectile to exit the primary tube, and a flow apparatus in fluid communication with the primary passage, the flow apparatus configured to draw gas from the primary passage to provide at least a partial vacuum in the primary passage.

The flow apparatus may include at least one of a blower, a pump, a roughing pump, a turbo molecular pump, or a chamber of compressed gas.

The projectile launching device may further include a connecting passage providing for fluid communication between the primary passage and an intake of the flow apparatus.

At least one of the connecting passage or the flow apparatus may further include a non-projectile explosive for altering the pressure in the primary passage.

The projectile launching device may further include a tube cover covering the opening of the primary tube.

The tube cover may include a consumable lightweight material.

The primary tube may include an inner surface and a sensor disposed in the inner surface, the sensor configured to activate a mechanical apparatus configured to move the tube cover away from the opening of the primary tube in response to sensing a projectile moving from the first end to the second end of the primary tube.

The projectile launching device may further include a secondary tube extending along a length between a first end and a second end and defining a secondary passage extending along a length thereof, the secondary tube disposed about the primary tube and having an opening at the second end of the secondary tube proximate the second end of the primary tube, and an additional flow apparatus in fluid communication with the secondary passage and configured to move gas through the secondary passage, wherein the opening at the second end of the secondary tube is configured to allow a gas to laminarly exit the secondary passage.

DETAILED DESCRIPTION

The principles of the present disclosure have particular application to projectile launching devices, such as guns and rifles, and thus will be described below chiefly in this context. It will of course be appreciated, and also understood, that the principles of the invention may be useful in other applications, such as launchers for fireworks and articles of clothing (e.g., t-shirts).

Figure 1:
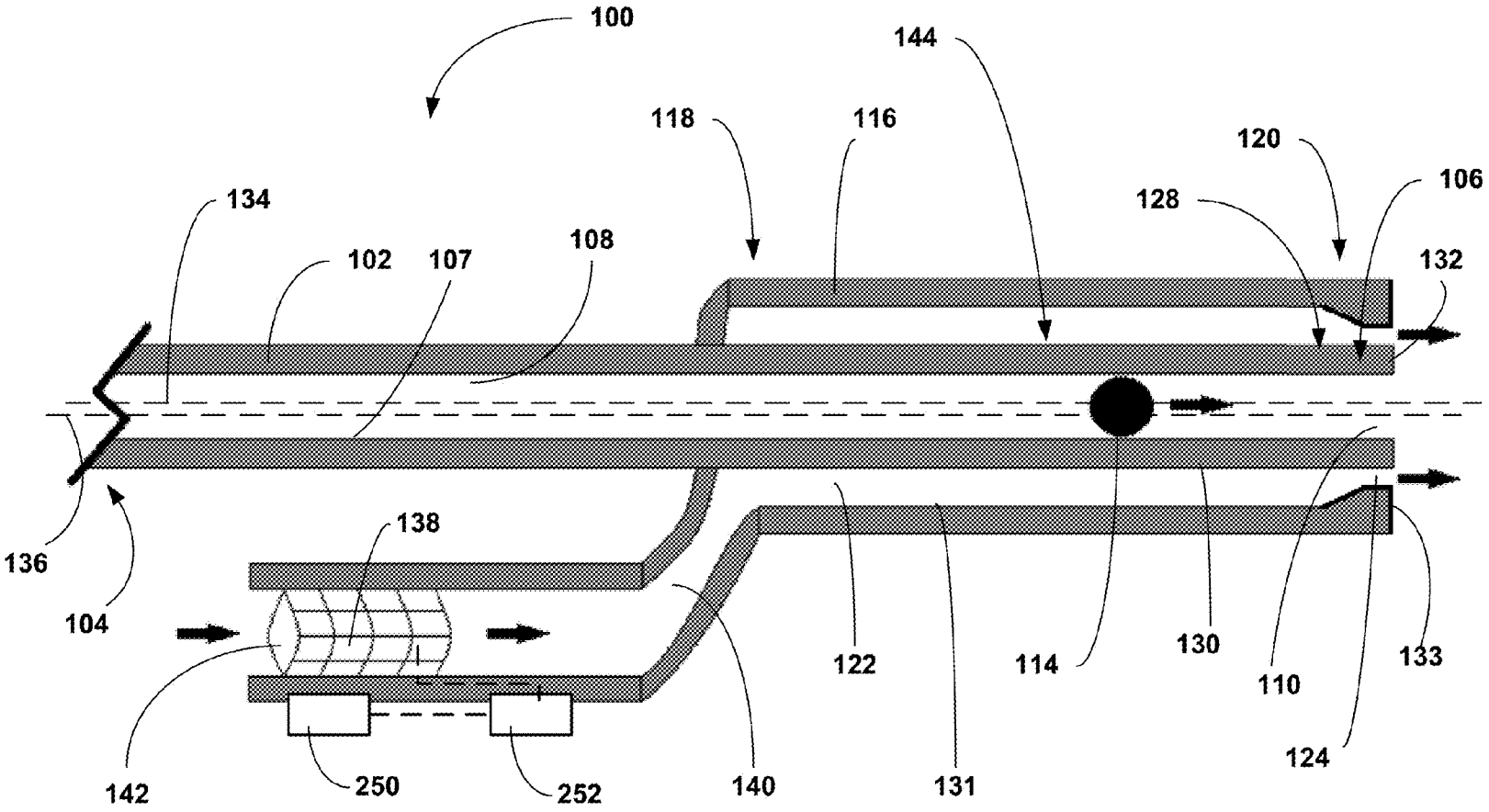
FIGS. 1-3 are schematic cross-sectional side views of an exemplary projectile launching device.

Referring now in detail to the drawings, and initially to FIG. 1, an exemplary projectile launching device is shown generally at 100. The projectile launching device includes a primary tube 102 extending along longitudinal axis 134 between a first end 104 and a second end 106. The inner surface 107 of the primary tube 102 defines a primary passage 108 extending between the first end 104 and the second end 106. The primary tube 102 includes an opening 110 at the second end 106 configured to allow a projectile 114 to exit the primary passage 108. The primary passage 108 may be cylindrical in shape. In some embodiments a cross-section of the primary passage 108 may be circular, while in other embodiments a cross-section of the primary passage 108 may be elliptical or of any other suitable shape.

The projectile launching device is shown in FIG. 1 as a part of a gun, and will primarily be described in this context. Accordingly, the primary tube 102 may be formed from a suitable material for firing a bullet (e.g., steel), may possess a suitable internal diameter for firing a bullet (e.g., .22 cal., 9 mm, 40 cal., or any other suitable size), and may include surface features such as rifling at the inner surface 107 of the primary tube 102. Although not specifically shown, the projectile launching device may include any suitable firing mechanism for initiating the launching of the projectile. For example, the projectile launching device embodied as a gun may include components such as a hammer, a firing pin, a trigger, and a magazine. Firing of the projectile may be conducted in any conventional manner. It will be appreciated that, in other embodiments, the projectile launching device may be another type of device, such as a firework launcher or clothing launcher (e.g., t-shirts), may be made of any suitable material, may have any suitable dimensions, and may include any suitable firing mechanism.

A secondary tube 116 extends along a longitudinal axis 136 between a first end 118 and a second end 120. The secondary tube 116 is disposed about the primary tube 102 and extends along at least a portion of the length of the primary tube 102 between the first end 104 and the second end 106. The longitudinal axis 134 of the primary passage 108 and the longitudinal axis 136 of the secondary passage 122 may be parallel. As shown in FIG. 1, the secondary tube 116 may extend along a distal portion 128 of the primary tube 102, nearest the second end 106 of the primary tube 102. The inner surface 131 of the secondary tube 116 and the outer surface 130 of the primary tube 102 at least partially define the secondary passage 122. The secondary passage 122 may be substantially annular in shape.

The secondary tube 116 includes an intermediary section 144 extending between the first end 118 and the second end 120 of the secondary tube 116, and an opening 124 at the second end 120. The opening 110 of the primary tube 102 may define a primary end face 132 and the opening 124 of the secondary tube 116 may define a secondary end face 133 disposed substantially parallel to the primary end face 132. In some embodiments (e.g., as shown in FIG. 1), the cross-sectional area of the opening 124 of the secondary tube 116 may be lesser than the cross-sectional area of an intermediary section 144 of the secondary passage 122 extending between the first end 118 and the second end 120. As shown, the inner surface 131 of the secondary passage 122 may be slanted inwards, towards either central longitudinal axis 134 or 136. In other embodiments, (e.g., as shown in FIGS. 5 and 6), the cross-sectional area of the opening 124 of the secondary tube 116 may be approximately the same as the cross-sectional area of an intermediary section 144 of the secondary passage 122 extending between the first end 118 and the second end 120. In still other embodiments (not specifically shown), the cross-sectional area of the opening 124 of the secondary tube 116 may be greater than the cross-sectional area of the intermediary section 144.

Although not specifically shown, in some embodiments the secondary passage 122 may include one or more features that are configured to induce a rotational component about the longitudinal axis 134, 136 to gas (e.g., air) passing through the secondary passage. For example, the secondary passage 122 may include one or more fixed or moving vanes, blades, or fins coupled to the inner surface 131 of the secondary tube 116 and/or the outer surface 130 of the primary tube 102. Such features may introduce a rotation to the passing air or gas that is similar to or approximately the same as the rotational component about the longitudinal axis 134 imparted to the projectile in embodiments wherein the inner surface 107 of the primary tube includes rifling.

Figure 3:
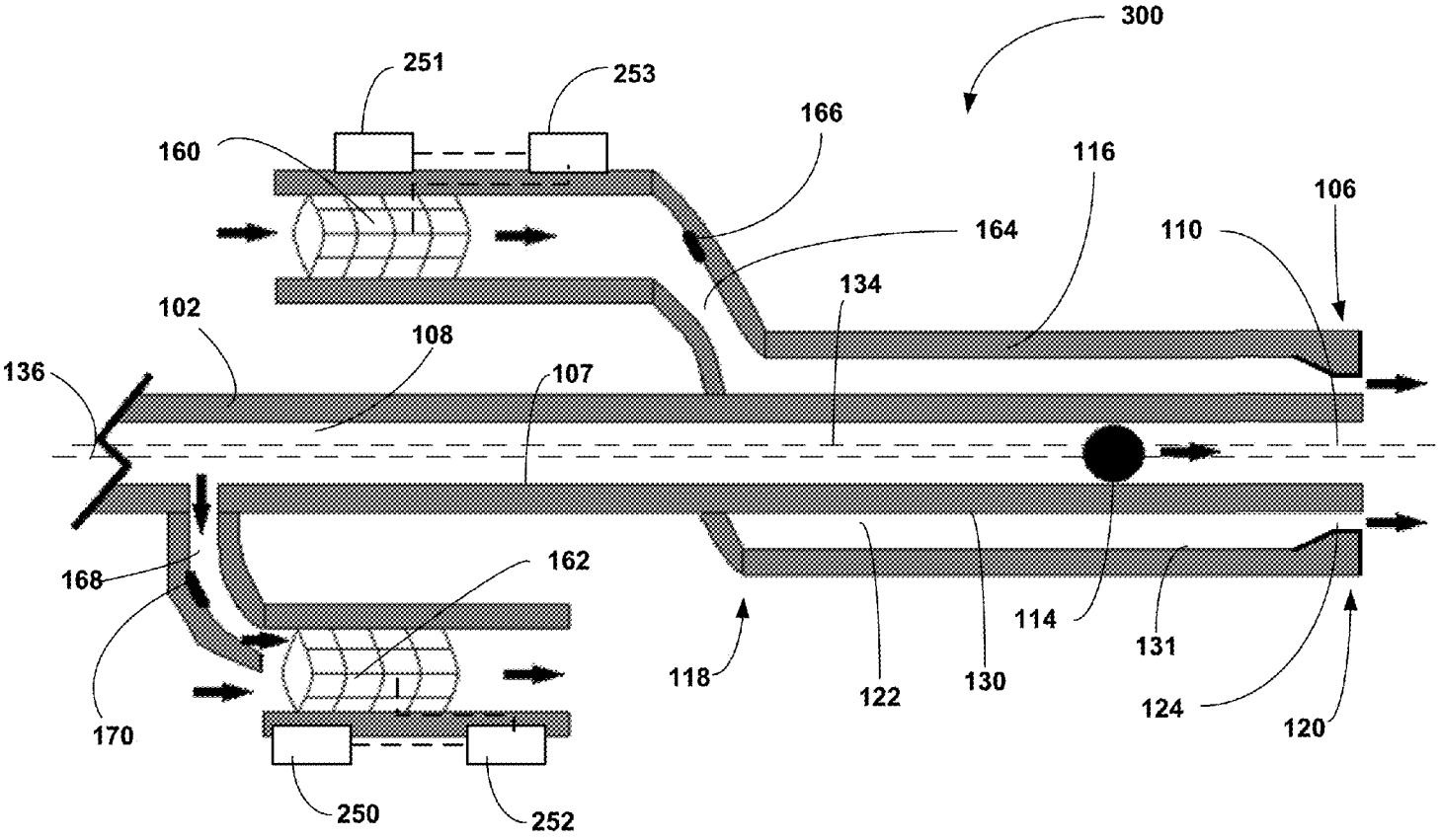

A flow apparatus 138 is in fluid communication with the secondary passage 122 via a connecting passage 140. The flow apparatus 138 may be configured to move at least one of air or gas through the secondary passage 122 and out the opening 124 of the secondary tube 116. In some embodiments, an intake 142 of the flow apparatus 138 may be open to the atmosphere providing for inducement of surrounding air into the secondary passage 122 or entrainment of surrounding air about the secondary tube 116. The flow apparatus 138 may be at least one of a blower, a pump, a roughing pump, or a turbo molecular pump. In other embodiments, the flow apparatus 138 may be coupled to a chamber of compressed gas (e.g., air) or a compressed liquid that may be rapidly decompressed into a gas. In the embodiment shown in FIG. 1, the projectile launching device includes one flow apparatus 138. It will be appreciated that, in other embodiments, the projectile launching device may include any suitable number of flow apparatuses (e.g., FIG. 3 shows an embodiment including two flow apparatuses 160, 162).

The opening 124 of the secondary tube 116 may be configured or shaped to allow a gas (e.g., air) moved through the secondary tube 116 by the flow apparatus 138 to laminarly exit the opening 124. In some embodiments, the secondary passage 122 may form a laminar flow annulus. The secondary tube 116 may be configured to direct a gas towards the second end 106 of the primary tube 102 in order to direct laminar air flow exiting the opening 124 of the secondary tube 116, which, for example, may be less than or equal to 2,300 Reynolds. Gas exiting the opening 124 may form a laminar blanket or an area of laminar flowing air into which a projectile 114 may enter upon exiting the primary passage 108 of the primary tube 102. The laminar flow may allow a projectile 114, which is exiting the primary tube 102, to enter undisturbed air at a higher velocity, therefore enabling the projectile 114 to move straighter and faster and increasing accuracy and range of the device 100 for launching the projectile 114.

The velocity of the air or gas exiting the opening 124 may be a function of the specifications of the flow apparatus 138 and/or a function of the dimensions of the secondary passage 122. For example, in embodiments where the cross-sectional area of the opening 124 of the secondary tube 116 is lesser than the cross-sectional area of an intermediary section 144 of the secondary passage 122 extending between the first end 118 and the second end 120, such configuration may create a venturi effect whereby the velocity of the gas (e.g., air) moving through the secondary passage 122 may increase prior to exiting the opening 124.

In embodiments where the primary face 132 is adjacent the secondary face 133, air may be drawn out of the primary passage 108 through the opening 110 of the primary tube 102 via inducement or entrainment of the air. Further, a partial vacuum may be generated in the primary passage 108 as air is induced or entrained out of the primary passage 108 through the opening 110. Resulting reduced pressure and reduced air friction inside the primary passage 108 of the primary tube 102 may provide additional advantages such as increased projectile velocity and effective range, in addition to reducing the sound produced by the device 100 for launching a projectile 114.

The projectile launching device 100 is shown in FIG. 1 in the firing state. As shown, the firing mechanism, such as a trigger, has been activated causing the projectile 114 to move in the primary passage 108 in a direction toward the opening 110. The flow apparatus 138, which may be powered by a power source 250 such as a battery or any suitable power source, may be active during firing of the projectile launching device 100. Activation of the flow apparatus 138 may be controlled by a controller 252. In some embodiments, the controller 252 may be configured to activate the flow apparatus 138 in response to the firing mechanism being activated, such as a trigger (not shown) being pulled. Therefore, in this state, the flow apparatus 138 may be active such that a gas (e.g., air) is directed towards the second end 106 of the primary tube 102. The gas may move through the secondary passage 122 of the secondary tube 116, laminarly exiting the opening 124 of the secondary tube 116. Gas laminarly exiting the opening 124 may form a laminar blanket (e.g., a cylindrical laminar blanket) or an area of laminar flowing air into which the projectile 114 may enter upon exiting the primary passage 108 of the primary tube 102.

In those embodiments in which the secondary passage 122 includes one or more features that are configured to induce a rotational component to gas (e.g., air) passing through the secondary passage, the gas is output having a rotating cylindrical laminar flow. Such flow may further reduce drag and friction with the external undisturbed air in those embodiments in which the projectile exits the primary passage with a rotational component.

Figure 2:
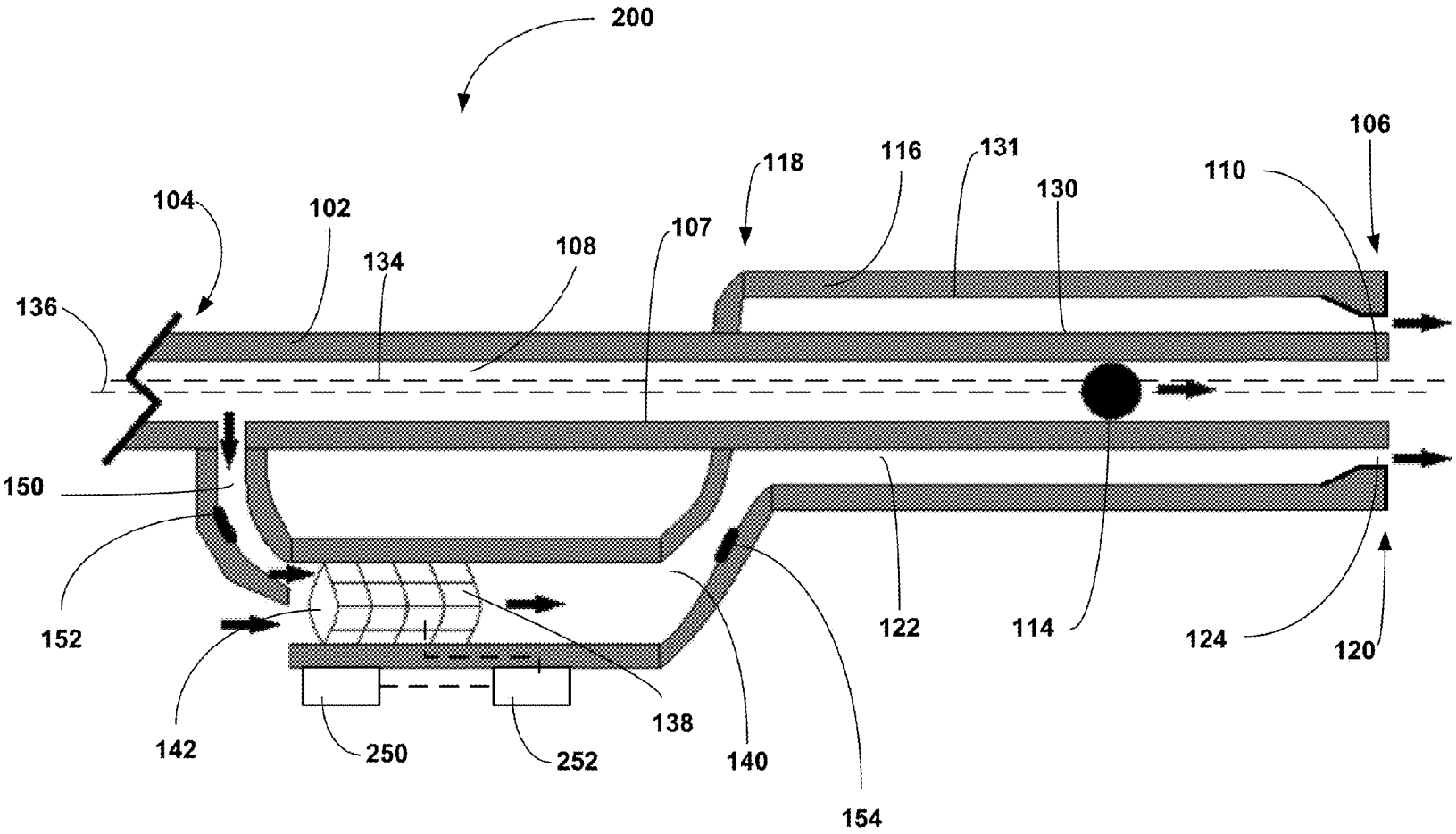

Turning now to FIG. 2, another embodiment of a projectile launching device is shown at 200. The projectile launching device 200 is similar to the above-referenced device 100, except as noted below. Consequently, the same reference numerals used for the projectile launching device 100 are used to denote features corresponding to similar features in the projectile launching device 200. In addition, the above description of the corresponding features of the projectile launching device 100 is equally applicable to the projectile launching device 200, except as noted below.

The projectile launching device 200 includes a connecting passage 150 providing fluid communication between the primary passage 108 and an intake 142 of the flow apparatus 138. In such an embodiment, the flow apparatus 138 may be configured to draw or vacuum gas from the primary passage 108, through the connecting passage 150, and into the intake 142, thereby providing at least a partial vacuum in the primary passage 108. At least a portion of the intake 142 may also be open to the atmosphere. Accordingly, a portion of the gas expelled from the secondary passage 122 may be drawn or vacuumed from the primary passage 108 and another portion of the gas expelled from the secondary passage 122 may be drawn or vacuumed from the atmosphere.

In some embodiments, a non-projectile explosive 152 for rapidly altering the pressure in the primary passage 108 may be included in the connecting passage 150. In other embodiments, a non-projectile explosive 154 may be included in the connecting passage 140 for rapidly altering the pressure in the secondary passage 122. Although not specifically shown, in still other embodiments, the non-projectile explosive 152 or 154 may also be included in the flow apparatus 138 or in another part of the projectile launching device 200.

The projectile launching device 200 is shown in FIG. 2 in the firing state. As shown, the firing mechanism, such as a trigger, has been activated causing the projectile 114 to move in the primary passage 108 in a direction toward the opening 110. The flow apparatus 138, which may be powered by a power source 250, may be active during firing of the projectile launching device 200, activation of which may be controlled by a controller 252. Thus, in this state, the flow apparatus 138 may be active such that a gas is being vacuumed from the primary passage 108 of the primary tube 102, which may result in at least a partial vacuum in the primary passage 108. The resulting reduced pressure or reduced air friction inside the primary passage 108 may provide additional advantages such as increased projectile velocity and effective range, in addition to reducing the sound produced by the device 200 for launching the projectile 114.

In this state, the flow apparatus 138 may also be active to direct a gas (e.g., air) from the primary passage 108 or from the atmosphere towards the second end 106 of the primary tube 102. The gas may move through the secondary passage 122 of the secondary tube 116, laminarly exiting the opening 124 of the secondary tube 116. Gas laminarly exiting the opening 124 may form a laminar blanket or an area of laminar flowing air into which the projectile 114 may enter upon exiting the primary passage 108 of the primary tube 102.

Turning now to FIG. 3, another embodiment of a projectile launching device is shown at 300. The projectile launching device 300 is similar to the above-referenced projectile launching device 100, 200, except as noted below. Consequently, the same reference numerals used for the projectile launching device 100, 200 are used to denote features corresponding to similar features in the projectile launching device 300. In addition, the above description of the corresponding features of the projectile launching device 100, 200 is equally applicable to the projectile launching device 300, except as noted below.

The projectile launching device 300 includes two flow apparatuses shown at 160 and 162. The first flow apparatus 160 is in fluid communication with the secondary passage 122 via a connecting passage 164. The first flow apparatus 160 may be configured to draw or vacuum gas (e.g., air) from the atmosphere and to move gas through the secondary passage 122. In the embodiment shown, the first flow apparatus 160 is not configured to draw or vacuum gas from the primary passage 108. The second flow apparatus 162 is in fluid communication with the primary passage 108 via a connecting passage 168. The second flow apparatus 162 may be configured to draw or vacuum gas (e.g., air) from the primary passage 108. In the embodiment shown, the second flow apparatus 162 is not configured to move gas through the secondary passage 122. The intake of the flow apparatus 162 is shown as being partially open to the atmosphere, although in other embodiments, the intake may be closed to the atmosphere such that any gas taken in by the flow apparatus 162 is provided through the connecting passage 168. Additionally, it will be appreciated that while FIG. 3 shows an embodiment including both first and second flow apparatuses 160 and 162, in other embodiments, the projectile launching device may only include the second flow apparatus 162.

The connecting passage 164 may include a non-projectile explosive 166 for pressurizing the secondary passage 122, while the connecting passage 168 may include a non-projectile explosive 170 for rapidly altering the pressure in the primary passage 108.

The projectile launching device 300 is shown in FIG. 3 in the firing state. As shown, the firing mechanism, such as a trigger, has been activated causing the projectile 114 to move in the primary passage 108 in a direction toward the opening 110. The flow apparatuses 160 and 162, which may be powered by respective power sources 250 and 251, may be active during firing of the projectile launching device 300, activation of which may be controlled by respective controllers 252 and 253. In other embodiments not specifically shown, the flow apparatuses 160 and 162 may be powered by a single power source (not shown) and activated by a single controller (not shown). Thus, in this state, the second flow apparatus 162 may be active such that a gas (e.g., air) is being vacuumed from the primary passage 108 of the primary tube 102, which may result in at least a partial vacuum in the primary passage 108. The first flow apparatus 160 may also be active to direct a gas (e.g., air) from the atmosphere towards the second end 106 of the primary tube 102. The gas may move through the secondary passage 122 of the secondary tube 116, laminarly exiting the opening 124 of the secondary tube 116. Gas laminarly exiting the opening 124 may form a laminar blanket or an area of laminar flowing air into which the projectile 114 may enter upon exiting the primary passage 108 of the primary tube 102.

Figure 4A:
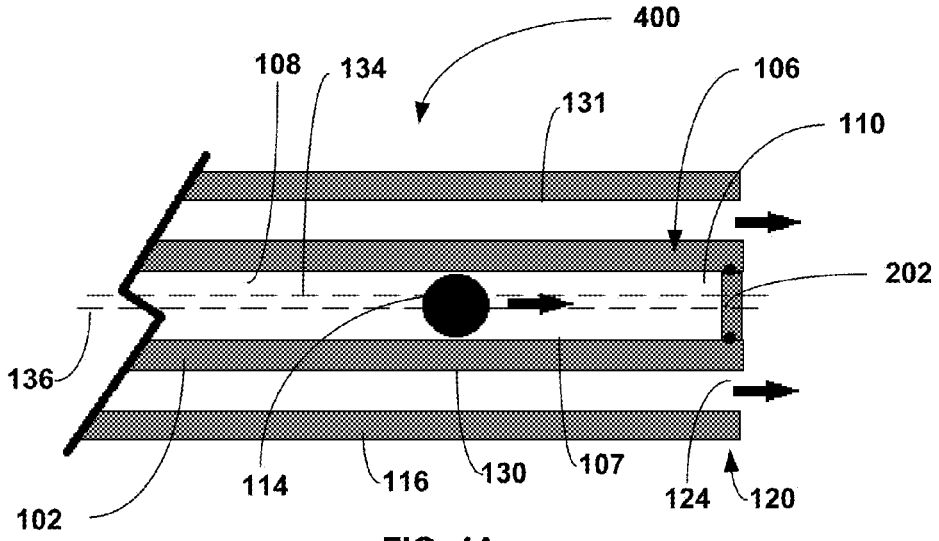
FIGS. 4A and 4B are schematic cross-sectional side views of portions of an exemplary projectile launching device.
Figure 4B:
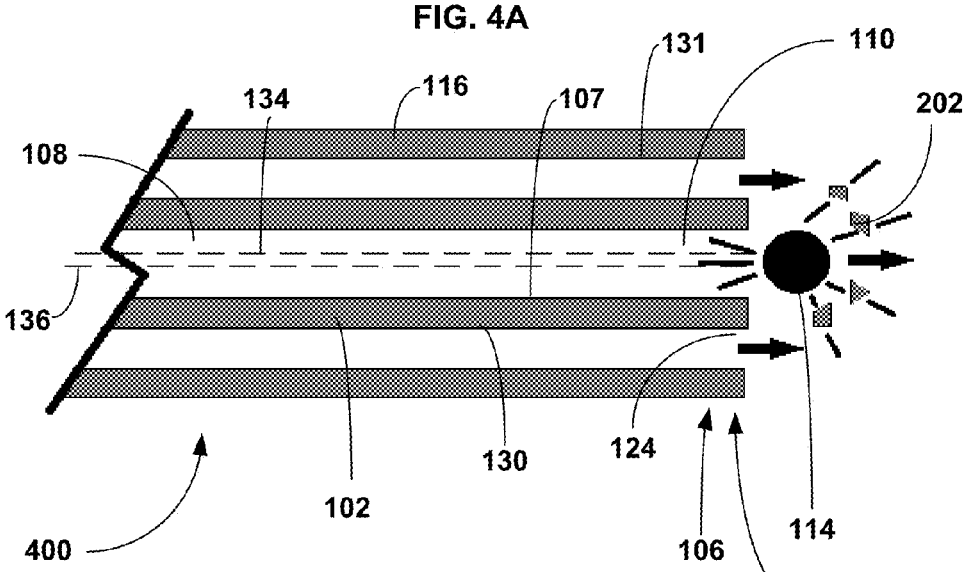

Turning now to FIGS. 4A and 4B, a portion of another embodiment of the projectile launching device is shown at 400. It will be appreciated that any of the projectile launching devices 100, 200, or 300 may be modified to include the features described with respect to the projectile launching device 400.

As shown, the projectile launching device 400 includes a tube cover 202 covering the opening 110 of the primary tube 102. The tube cover 202 seals the primary passage 108 from the atmosphere at the second end 106 of the primary tube 102. To provide such sealing, the tube cover 202 may include a sealing component 203 such as an o-ring or any other suitable sealing component. A partial or complete vacuum of the primary passage 108 may be effected using the tube cover 202 in conjunction with the flow apparatus 138 or 162. By reducing the pressure and/or the air friction inside the primary passage 108 during firing of the projectile, the projectile may be launched from the device with an increased projectile velocity and effective range. The tube cover 202 may be made of a consumable lightweight material. The tube cover 202 may also be configured to break apart or otherwise move away from the opening 110 of the primary tube 102 upon contact with a projectile 114 and without affecting the velocity, accuracy, or range of the projectile 114.

FIG. 4A shows the projectile launching device 400 in a firing state. As shown, the projectile 114 is moving in the primary passage 108 in a direction toward the tube cover 202. In this state, the primary passage 108 may be under partial or complete vacuum due to actuation of the flow apparatus 138 or 162. FIG. 4B shows the projectile launching device 400 in a post-firing state. As shown, the projectile 114 has exited the primary passage 108. Upon exiting the primary passage 108, the projectile 114 has broken through the tube cover 202, which is shown in a fractured state in FIG. 4B.

Figure 5A:
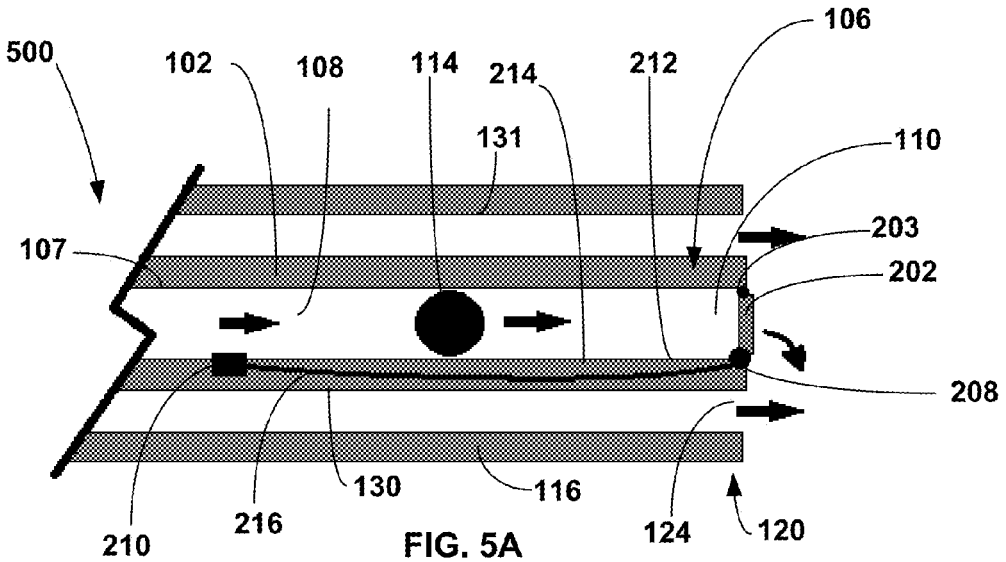
FIGS. 5A and 5B are schematic cross-sectional side views of portions of another exemplary projectile launching device.
Figure 5B:
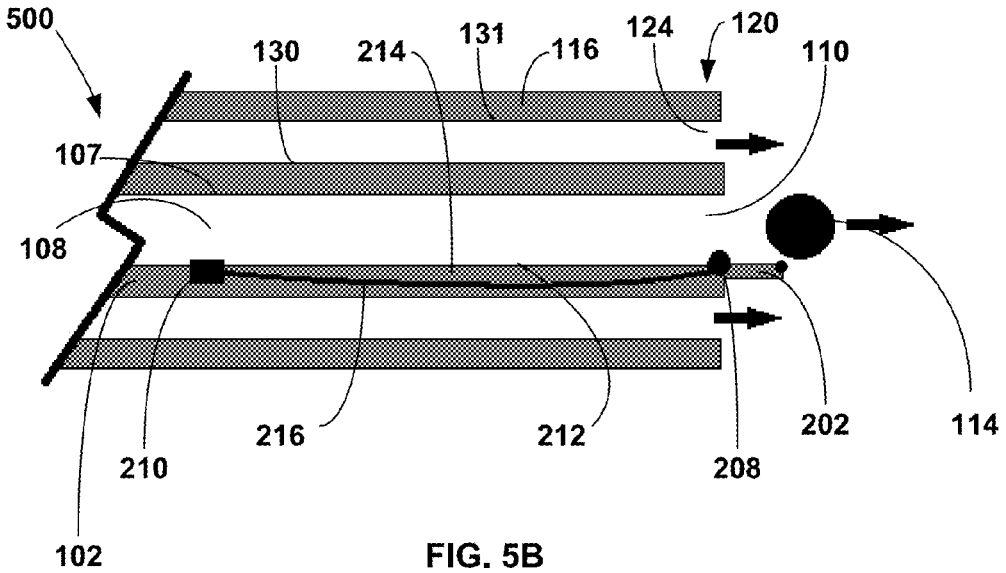
Figure 6:
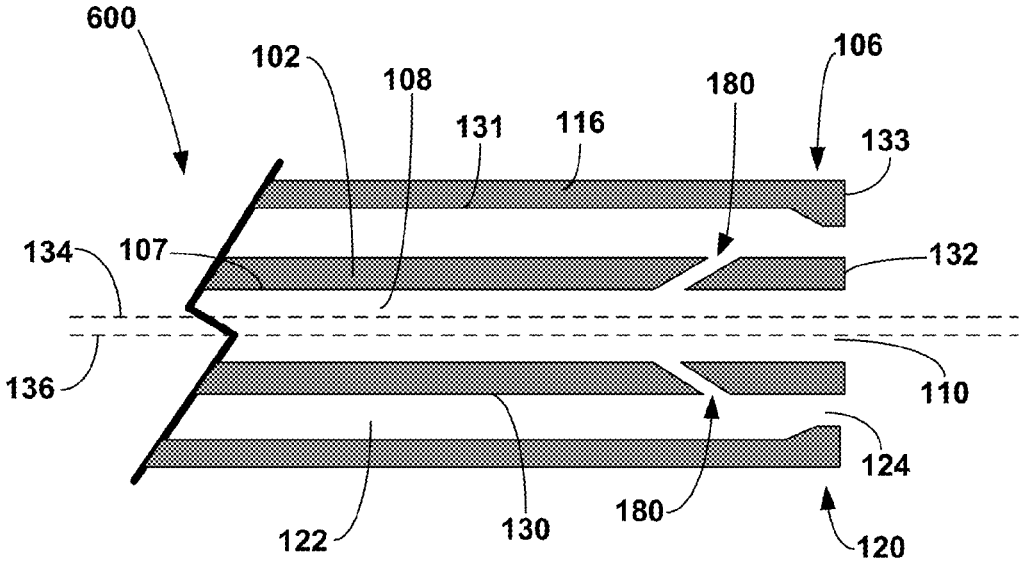
FIG. 6 is a schematic cross-sectional side view of portions of another exemplary projectile launching device.

Turning now to FIGS. 5A and 5B, a portion of another embodiment of the projectile launching device is shown at 500. It will be appreciated that any of the projectile launching devices 100, 200, or 300 may be modified to include the features described with respect to the projectile launching device 500.

FIGS. 5A and 5B show an alternative embodiment in which the tube cover 202 may be configured to retract, flip, or otherwise move away from the opening 110 of the primary tube 102 via a mechanical apparatus 208, such as a motor or other suitable apparatus. The tube cover 202 seals the primary passage 108 from the atmosphere at the second end 106 of the primary tube 102. To provide such sealing, the tube cover 202 may include a sealing component 203 such as an o-ring or any other suitable sealing component. A partial or complete vacuum of the primary passage 108 may be effected using the tube cover 202 in conjunction with the flow apparatus 138 or 162. By reducing the pressure and/or the air friction inside the primary passage 108 during firing of the projectile, the projectile may be launched from the device with an increased projectile velocity and effective range.

Actuation of the mechanical apparatus 208 may be effected by a sensor 210, such as a motion sensor, pressure sensor, pressure transducer, or other suitable sensor, disposed in an inner surface 212 of a wall 214 of the primary tube 102. The mechanical apparatus 208 and the sensor 210 may be powered by the power source 250 or 251 or any other suitable power source. The sensor 210 may be communicatively connected to the mechanical apparatus 208 via wiring 216, such as electrical wiring, fiber-optic wiring, or other suitable wiring. Via said communicative connection, the tube cover 202 may be configured to move away from the opening 110 of the primary tube 102 prior to the ejection of the projectile 114 from the primary passage 108. Accordingly, a projectile 114 moving in the primary passage 108 from the first end 104 to the second end 106 may pass the sensor 210 thereby activating the mechanical apparatus 208 to move the tube cover 202 away from the opening 110 of the primary tube 102.

FIG. 5A shows the projectile launching device 500 in a firing state. As shown, the projectile 114 is moving in the primary passage 108 in a direction toward the tube cover 202. In this state, the primary passage may be under partial or complete vacuum due to actuation of the flow apparatus 138 or 162. The projectile 114 has moved past the sensor 210, which results in actuation of the mechanical apparatus 208 effecting movement of the tube cover 202. FIG. 5B shows the projectile launching device 500 in a post-firing state. As shown, the projectile 114 has exited the primary passage 108. The tube cover 202 has been moved to an open state prior to the projectile 114 exiting the primary passage 108.

Turning now to FIG. 6, a portion of another embodiment of the projectile launching device is shown at 600. It will be appreciated that any of the projectile launching devices 100, 200, 300, 400, or 500 may be modified to include the features described with respect to the projectile launching device 600.

As shown, the projectile launching device 600 includes an exhaust diversion passage 180 extending and providing fluid communication between the primary passage 108 and the secondary passage 122. In the illustrated embodiment, the exhaust diversion passage 180 is proximate the second end 106. The exhaust diversion passage 180 may be configured to allow a portion of the gasses passing along the primary passage 108 to transfer from the primary passage 108 to the secondary passage 122. The exhaust diversion passage 180 is schematically shown in FIG. 6 as through holes extending through the primary tube 102 at a non-perpendicular angle relative to the longitudinal axis 136. In other embodiments, the exhaust diversion passage 180 may be embodied as one or more holes, vanes, fins, or blades having a suitable orientation.

In the firing state, the exhaust diversion passage 180 may be configured to divert gas from the primary passage 108 directly to the secondary passage 122. The diversion of gas from the primary passage 108 to the secondary passage 122 may increase the laminar gas flow exiting from the secondary passage. In some embodiments, the exhaust diversion passage 180 may aid in evacuating the primary passage 108 via inducement, entrainment, or diversion. In other embodiments, the additional connecting passage 180 may be configured such that a rotational component about the longitudinal axis 134, 136 is imparted on the gas diverted from the primary passage 108. The rotating gas diverted to the secondary passage 122 may influence other air passing through the secondary passage 122 such that the gas is output from the secondary passage 122 having a rotating cylindrical laminar flow.

In addition to the above, the additional connecting passage 180 may lower the primary passage pressure behind the projectile as the projectile passes the exhaust diversion passage 180. This may reduce the induced turbulence behind the projectile as it exits the primary passage that is caused by high pressure gas behind the projectile.

Although the invention has been shown and described with respect to a certain preferred embodiment or embodiments, it is obvious that equivalent alterations and modifications will occur to others skilled in the art upon the reading and understanding of this specification and the drawings. In particular, in regard to the various functions performed by the above described elements (components, assemblies, devices, compositions, etc.), the terms used to describe such elements are intended to correspond, unless otherwise indicated, to any element which performs the specified function of the described element (i.e., that is functionally equivalent). In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A projectile launching device, comprising: a primary tube extending along a length disposed between a first end and a second end and defining a primary passage extending along a length thereof, the primary tube comprising an opening at the second end of the primary tube configured to allow a projectile to exit the primary passage; a secondary tube extending along a length between a first end and a second end and defining a secondary passage extending along a length thereof, the secondary tube disposed about the primary tube and having an opening at the second end of the secondary tube proximate the second end of the primary tube; a flow apparatus in fluid communication with the secondary passage, the flow apparatus comprising a blower and an intake that is open to the atmosphere and configured to move surrounding gas external to the primary passage through the secondary passage; a controller configured to activate the flow apparatus and cause the gas to move through the secondary passage upon activation of a firing mechanism of the projectile launching device; and a power source configured to supply power to the flow apparatus, wherein the power source is coupled to the controller and the controller controls the supply of the power from the power source to the flow apparatus, and wherein the opening at the second end of the secondary tube is configured to allow the gas to laminarly exit the secondary passage.

2. The projectile launching device of claim 1, wherein at least one of the primary tube and the secondary tube are substantially cylindrical in shape.

3. The projectile launching device of claim 1, wherein the secondary passage is substantially annular in shape.

4. The projectile launching device of claim 1, wherein the secondary passage is at least partially defined by at least a portion of an outer surface of the primary tube.

5. The projectile launching device of claim 1, wherein the secondary passage comprises one or more fixed or moving vanes, blades, or fins configured to impart a rotational component to gas passing through the secondary passage.

6. The projectile launching device of claim 1, wherein the secondary passage comprises an intermediary section extending between the first end and the second end of the secondary tube, and wherein the cross-sectional area of the intermediary section is greater than a cross-sectional area of the opening of the secondary tube.

7. The projectile launching device of claim 1, wherein the opening of the primary tube defines a primary end face and the opening of the secondary tube defines a secondary end face disposed substantially parallel to the primary end face.

8. The projectile launching device of claim 1, further comprising a connecting passage, the connecting passage providing fluid communication between the primary passage and an intake of the flow apparatus.

9. The projectile launching device of claim 8, wherein the flow apparatus is configured to draw gas from the primary passage thereby providing at least a partial vacuum in the primary passage.

10. The projectile launching device of claim 1, further comprising an exhaust diversion passage, the exhaust diversion passage providing fluid communication between the primary passage and the secondary passage.

11. The projectile launching device of claim 1, wherein the secondary passage is configured to draw air out of the opening of the primary passage via inducement or entrainment.

12. The projectile launching device of claim 1, wherein the intake of the flow apparatus is configured to move the gas through the secondary passage via inducement of surrounding air into the secondary passage.

13. The projectile launching device of claim 1, further comprising a tube cover covering the opening of the primary tube.

14. The projectile launching device of claim 13, wherein the tube cover comprises a consumable lightweight material.

15. The projectile launching device of claim 13, wherein the primary tube comprises an inner surface and a sensor disposed in the inner surface, the sensor configured to activate a mechanical apparatus configured to move the tube cover away from the opening of the primary tube in response to sensing a projectile moving from the first end to the second end of the primary tube.

16. The projectile launching device of claim 1, wherein the secondary passage is isolated from the primary passage from the first end of the secondary tube to the second of the secondary tube.

17. The projectile launching device of claim 1, wherein the firing mechanism is a trigger and the controller is configured to activate the flow apparatus upon the trigger being pulled.

* * * * *